United States Patent [19]

Rule, III et al.

[11] 4,183,224

[45] Jan. 15, 1980

[54] METHOD AND APPARATUS FOR TEMPERATURE AND HUMIDITY CONTROL WITHIN A CHAMBER

[75] Inventors: Adrian O. Rule, III; William E. Bartley, III, both of Chagrin Falls, Ohio

[73] Assignee: Integrated Development and Manufacturing, Chagrin Falls, Ohio

[21] Appl. No.: 880,196

[22] Filed: Feb. 22, 1978

[51] Int. Cl.[2] ..... F25D 17/06; F25D 23/00

[52] U.S. Cl. ..... 62/91; 62/93; 62/271

[58] Field of Search ..... 62/91, 92, 93, 271

[56] References Cited

U.S. PATENT DOCUMENTS

| | | | |
|---|---|---|---|
| 1,236,535 | 8/1917 | Bloom | 62/91 |
| 1,846,875 | 2/1932 | Karr et al. | 62/91 |
| 3,042,383 | 7/1962 | Pennington | 62/91 |
| 3,119,239 | 1/1964 | Sylvan | 62/93 |
| 3,153,914 | 10/1964 | Meckler | 62/271 |
| 3,200,606 | 8/1965 | Hewett et al. | 62/271 |
| 3,401,530 | 9/1968 | Meckler | 62/93 |
| 3,417,574 | 12/1968 | Kelley | 62/93 |

*Primary Examiner*—Lloyd L. King

*Attorney, Agent, or Firm*—Oldham, Oldham, Hudak & Weber Co.

[57] ABSTRACT

The invention relates to a method and apparatus for precise temperature and humidity control within a confined or determined chamber. Essentially, the method involves determining a desired condition in a controlled space. The essence of the concept is to provide humidity control by the addition of moisture at all operating conditions and, in effect, never having to control dehumidification. Hence, the system is much more controllable than previous approaches, which as a result achieves energy conservation. In addition, the method for heating or cooling is to insure that the heating or cooling does not affect the humidity, but that humidity is added after all the desired temperature relationships are achieved, which enables the system to eliminate control into the dehumidification mode. Further, the process includes a higher air flow rate than normally utilized, all of which improves the precision of the humidification and temperature control process. The apparatus to achieve the invention is arranged in a neat configuration to achieve better mixing of steam humidification with dry heated air, the positioning of the apparatus to achieve the desired air flow characteristics through the room, and more uniformity with substantial elimination of temperature variations by lights, or people entering or leaving. Further, the apparatus includes structure to cool the conditioned air without stripping moisture.

The system is overall more energy conservative when contrasted to previous systems because only a small percentage of makeup air is added to a large quantity of circulated air with the makeup in effect controlling the temperature and humidity of the circulated air.

8 Claims, 5 Drawing Figures

METHOD AND APPARATUS FOR TEMPERATURE AND HUMIDITY CONTROL WITHIN A CHAMBER

PRIOR ART

To the best of our knowledge, all prior art attempts to achieve temperature and humidity control have been to work to the left side of a line between the desired point of temperature and humidity control, and the point the temperature and humidity reaches after it has passed through the desired control space, as shown on a psychrometric chart. That is to say that the normal situation is to over cool the air which is heated up after it leaves the confined space, in order to effectively extract moisture. The air is then slightly reheated with moisture added on demand of a humidity control, the final input condition to the control space obtained by additional large reheat. In any event, a system penalty is paid by the large energy removal by initially dropping the temperature of all of the air which is naturally and normally raised as it passes through the control area, in order to dehumidify, followed by putting large amounts of energy back into the system over the reheat portion when moisture is added to bring the system back to the desired initial temperature and humidification points. Hence, this type of system really is operating to the left side of a line on a psychrometric chart from a desired point to the point that that occurs, after the air moves through the controlled space. psychrometric chart is commonly understood by those acquainted with this field, and includes charted slope lines representing relative humidity, wet bulb, enthalpy, dew point and, in effect, all of the known physical properties with respect to air, as temperature and moisture are concerned.

This prior art system not only is going to cost more to operate because of the energy obligations for cooling the air down, but also adding the heat back in once the air has been over cooled. It is not going to be able to achieve as precise a control within the chamber because heretofore, recognized air flow rates are not believed to be sufficient to create a precise enough control condition, especially as the size of the chamber gets larger.

The system of the present invention has established that higher flow air flow rates can be utilized without problems of noise or disturbance because of drafts or air fluid movement within the confined space. The reason for this is that the air in our duct system under load conditions does not vary more than 3° F. to 5° F. from the controlled zone temperature. Hence, even with larger than normal air changes within the space, nothing unpleasant or distracting is noticed because the temperature and humidity are so constant.

OBJECTS OF THE INVENTION

The general object of the invention is to provide a controlled environment within a chamber wherein relative humidity and temperature can be maintained within precise limits, and can be done with a minimum of energy use by operating on the principle of always adding moisture to the air flow rather than effecting dehumidification in the recirculating air loop.

A further object of the invention is to provide a system wherein the coil on the recirculating air system is operated dry so the humidity control is totally achieved by controlled moisture addition.

A further object of the invention is with respect to the coil on the recirculation air system running dry, in that it reduces the amount of moisture to be used in order to achieve control to make the overall system energy conservative. Further, the coolant in the coil operates at a higher temperature to still achieve desired cooling, which results in energy conservation.

A further object of the invention is to permit additional moisture to be incorporated for humidification ahead of the main recirculating air blower, in order to achieve good mixing of the moisture in the air and uniform humidity in the supply duct to avoid stratifications and non-uniformity of air humidity.

A further object of the invention is to provide a separate controlled air exhaust through the ceiling and over the light fixtures so that the presence of the lighting fixtures does not disturb the uniformity of temperature and relative humidity in the enclosure.

A further object of the invention is to provide an air flow significantly larger than heretofore utilized to achieve more uniformity within the control space.

A further object of the invention is to effectively achieve control of the humidity and temperature in the large air flow by a small makeup air input which is thoroughly mixed into the large air flow.

A further object of the invention is to provide dehumidification only to the makeup air, thus achieving energy conservation.

A further object of the invention is to operate to the right of a line between the desired temperature and humidity and that which represents the leaving temperature and humidity on a psychrometric chart.

The aforesaid and other objects of the invention are achieved by a method to achieve precise controlled humidity and temperature with a confined space wherein the process operates to the right of a line of a physchrometric chart between the point of desired temperature and humidity entering the confined space and the temperature and humidity in the air leaving the space which comprises the steps of (a) effecting circulation of a predetermined volume of air through the control space to achieve a substantially uniformed distribution of the air throughout the space;

(b) thoroughly mixing into the main stream a small portion of makeup air at a controlled humidity and temperature level to return the main stream to about the desired temperature and humidification levels;

(c) additionally selectively cooling the main stream of air with makeup air mixed without stripping any moisture therefrom;

(d) selectively adding moisture to the mixed air flow stream to bring the humidification level up;

(e) providing moving force to the air stream immediately subsequent to moisture addition to uniformly distribute the moisture throughout the air stream; and (f) effecting control of the makeup air input, the selective cooling and selective moisture addition by control means within the confined space.

The apparatus to achieve precisely controlled humidification and temperature levels within a confined space, comprises (a) means to provide a main air flow path substantially uniformly through the confined space;

(b) means to sense moisture and temperature within the confined space;

(c) means to provide selective cooling and humidification to the main air stream through the confined space; and (d) means to provide selective amounts of makeup air at controlled humidity and temperature levels for thorough mixing with the main air stream prior to its entry into the confined space to achieve predetermined temperature and humidity levels within the main stream prior to its entry into the confined space.

DESCRIPTION OF THE INVENTION

Figure 1:
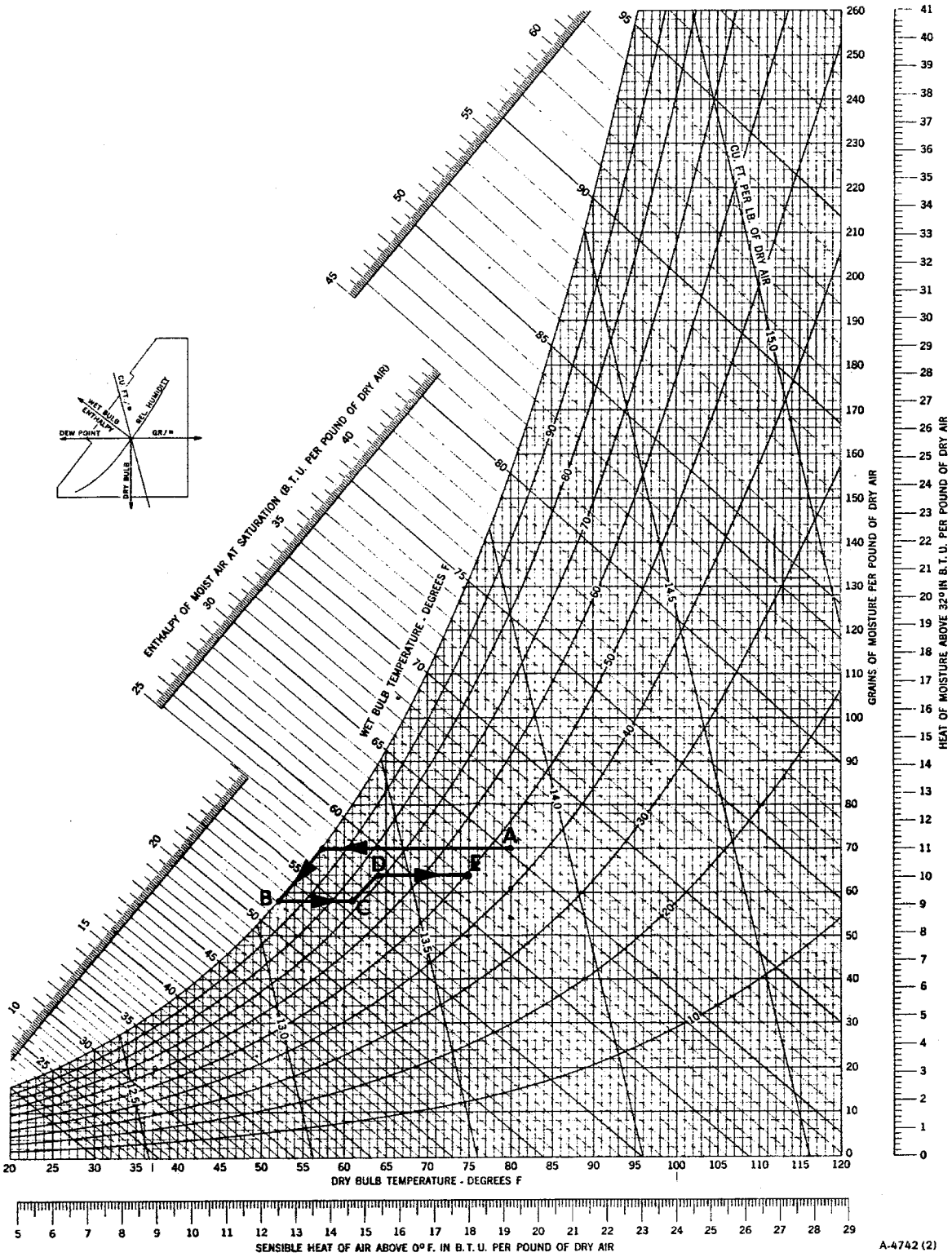
FIG. 1 is a graphic illustration of the conventional approach to temperature and humidity control in the controlled space.

Referring particularly to the graph of FIG. 1, point E is the desired condition for air entering a controlled space. As the air moves through the space, normally its temperature and humidity will increase to a point chosen as A. Point A is the air removal duct from the controlled space and, typically, as the air moves from point A, cooling equipment moves the air from point A to point B which, at that time, extracts moisture over part of this process when the cooling takes the temperature down to the 100 percent humidity level and then is further cooled and dehumidified to a dry bulb temperature B. The air is then reheated from point B to, typically, about point C, with moisture normally added as steam humidification incurring from point C to point D on demand of a humidity control, the final condition E obtained by additional reheat from D to E on demand of a temperature control sensor. Sometimes, the total preheat occurs in one step prior to the rehumidification process, so that the rehumidification from point C to D would take the air directly to point E. In any event, a large system penalty is paid by the energy removal from A to B, followed by putting large amounts of energy back into the system over the reheat portions B to C and D to E.

In contrast, and referring to FIG. 2, again we have selected E as the desired condition in a controlled space, but labeled this E'. As the air moves through the space, it again goes to a higher temperature and humidity condition, again designated as A'. At this point, when the air leaves the controlled space, we mix hot dry air, at a condition such as B', with the air at condition A, this resulting in a mixture condition C'. The air is cooled from C' to D' on demand of a temperature control in the controlled space and then, as a final step, moisture is added, preferably as steam, from D' to E' on demand of a humidity control sensor.

Hence, it can be seen that in this system, the cooling energy is just that, from point C' to point D', as compared to point A to B in the conventional approach of the graph of FIG. 1. Further, in our system, there is no direct reheat process compared to point B to C, and point D to E in the conventional approach of FIG. 1.

It should be understood that as an easy comparison, our system operates and approaches point E from the right side of a line between E' and A', whereas the conventional system operates and approaches E from the left side of a line between point E and point A. This, of course, represents a substantial energy saving.

Figure 2:
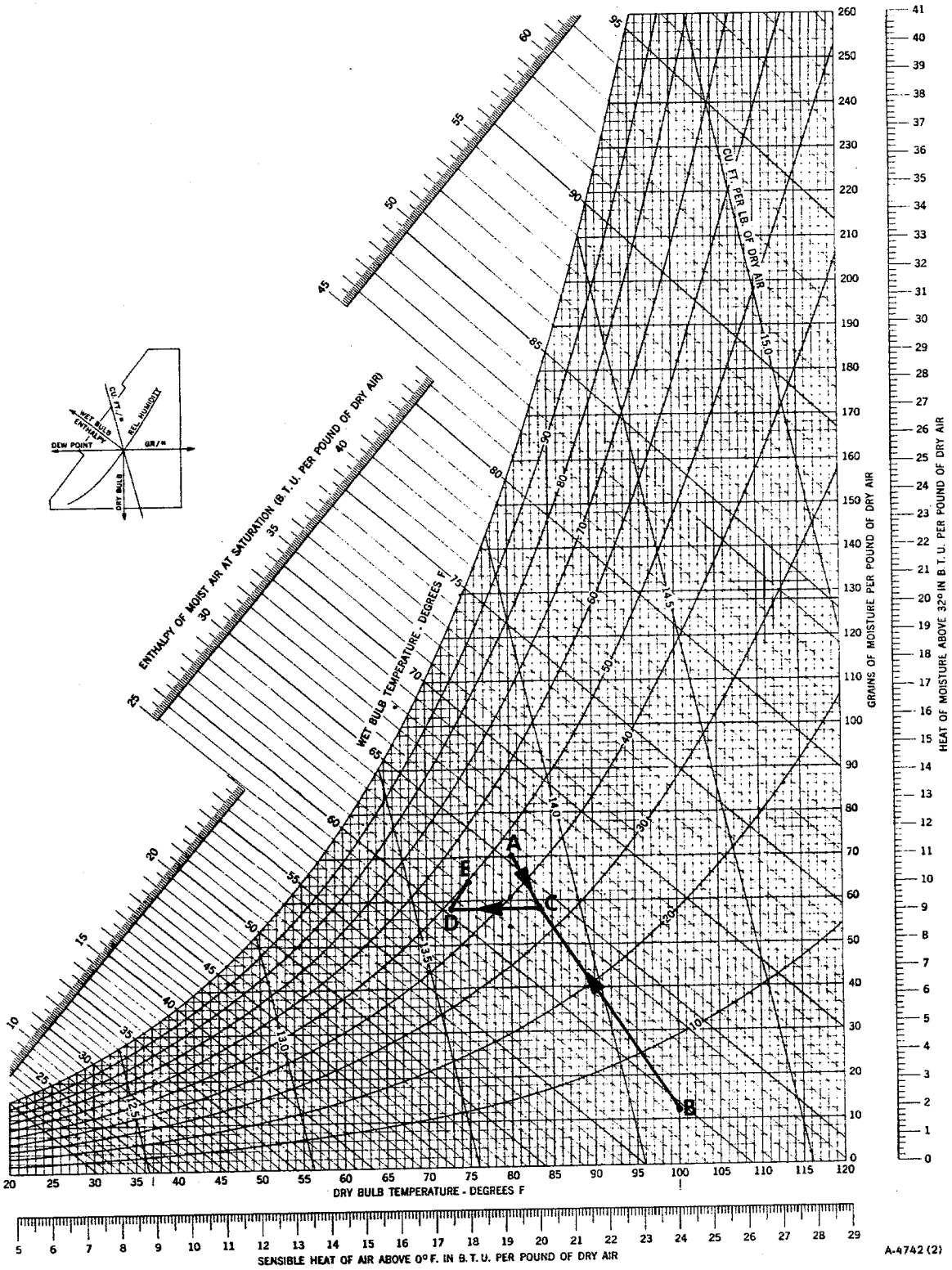
FIG. 2 is a graph similar to FIG. 1, except incorporating the approach of the invention.
Figure 3:
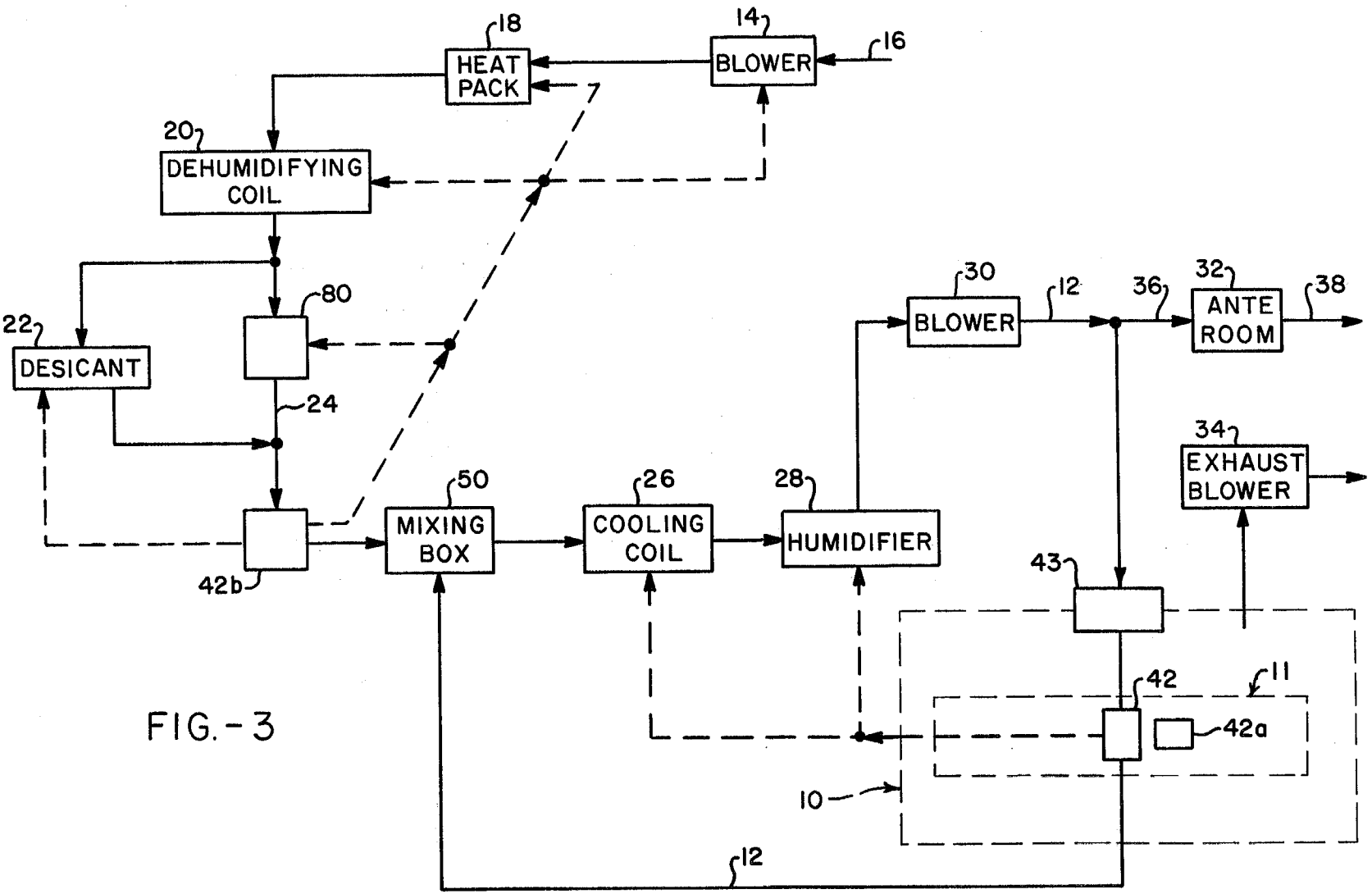
FIG. 3 is a block diagram of the system components utilized to achieve the optimum system flow shown by the graph of FIG. 2.

In order to achieve the preferred process operation of the graph of FIG. 2, we incorporate equipment shown in the block diagram of FIG. 3, which generally represents a room 10 having a control zone 11 within the room 10. This control zone 11 is the area in which it is desired, for example, to maintain about a 72° F. reading and a 50 percent relative humidity, with changes through the zone of less than 1 percent relative humidity, plus or minus. The zone 11 is normally about centrally located in the room 10 of whatever cubic footage needed for the operations within the room, yet our system can operate with cubic footage of, for example, as low as 350 cubic feet to 20,000 cubic feet, all utilizing the same principle as shown in FIG. 2 and with essentially the same equipment as will be further described hereinbelow. The zone 11 can actually be between 25 percent to about 75 percent of the volume of the room, but does not function well if it is in close proximity to the walls, ceiling or floor. The air flow line is generally indicated by the numeral 12 and, of course, is shown entering the control zone 11 and leaving the control zone 11 with the directional flow being by the general arrows. The system then includes makeup air directed in through a blower 14, as indicated by input line 16, which passes through an optional heat pack 18 (needed only if air temperature is too low coming in), a dehumidification coil 20, if necessary, which cooperates with a desiccant package 22, or is directly bypassed through line 24 to make up the input for the return of line 12, which then passes through the cooling coil indicated by block 26, the steam humidification input indicated by block 28, and the mixing blower 30. The final features of the system include an optional anteroom 32 and an optional exhaust blower 34.

To understand the basic system, it should be understood that preferably the chamber 10 is pressurized with a bleed into the anteroom 32, to provide a certain amount of pressure into the anteroom, this being by input line 36, although we have found that operational control of the system can be achieved without the anteroom 32 at all and, hence, the line 36 and anteroom 32 can be eliminated. However, if an anteroom 32 is utilized with input over line 36, then an exhaust from the anteroom over line 28 is likewise provided.

Figure 4:
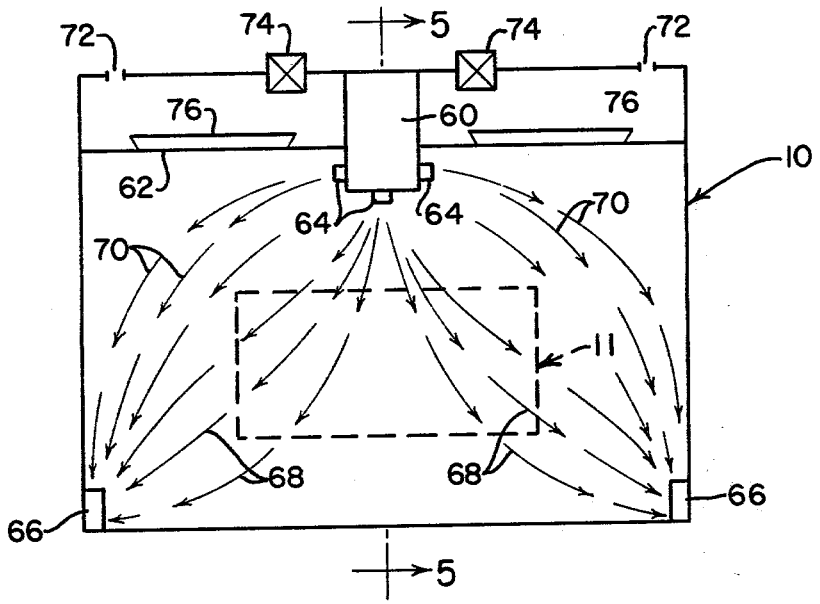
FIG. 4 is a schematic indication of the structural characteristics of the control zone itself looking at it from the end.
Figure 5:
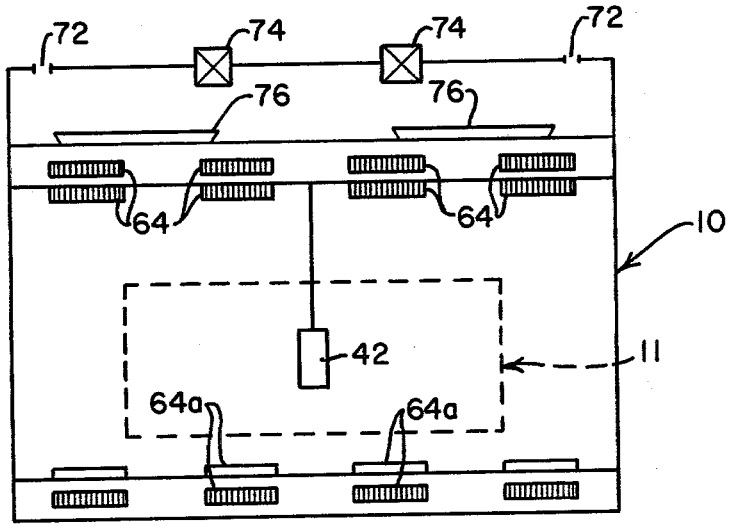
FIG. 5 is a schematic indication of the structural characteristics of the control zone itself looking at it from line 5—5 of FIG 4.

For a better understanding of the preferred configuration of the controlled room or space 10, reference should be had to FIGS. 4 and 5 which indicate a typical space 10 that comprises four walls, a ceiling and a floor, not identified by numerals, which in total will make up the cubic feet desired for the operations selected to be carried on within the room. In order to achieve the preferred process operation, the graph of FIG. 2, we have found that for most control zones or spaces, of say not more than 40 feet wide, it is preferable to use a single supply duct 60 extending down the middle top of the room underneath the false ceiling 62 as indicated in FIG. 4. The duct 60 will include substantially uniformly spaced supply louvers 64 which we have found work best when extended out from the side of the duct and from the bottom as indicated in FIGS. 4 and 5. The extension out from the side tends to not disturb the air flow within the main duct 60 and gives a more uniform air flow pattern throughout the confined space. The actual dimensional size of the supply duct 60 will be calculated to carry the total air flow required to achieve the 4 to 6 cubic feet per minute per square foot of the floor space in the room 10.

We have found that preferably in a room that is greater than 10 feet wide but less than 40 feet, that two return ducts indicated by numerals 66, which are located down the lower sides of the room parallel to the supply duct 60 and again with louvered intakes, uniformly spaced along their lengths, will quite adequately suffice to achieve the return air configuration of the system. Naturally, the return duct 66 must be substantially equal in total air flow capacity to the supply duct 60 and we have found that making them longer and narrower to extend up the side walls is probably preferable to making them square, although this design consideration is most dependent upon the equipment utilized in the room and can conform to tables and/or equipment associated therewith. In essence, the air flow pattern through the room is best seen in FIG. 4 as depicted by the arrows 68 extending down from the bottom of duct 60 and the arrow 70 extending out the side ducts to provide what is considered to be a very uniform air flow pattern throughout the control zone. The number of louvers 64 on the supply duct and louver 64*a* on the return ducts is entirely dependent upon the size of the room and the air flow and can be easily calculated to give a uniform distribution of the input air flow throughout the room to the return ducts.

Preferably, there is a false ceiling 62 just above the side mounted supply duct louvers. We have found that mounting a suitable number of exhaust ports 72 in the actual ceiling above the false ceiling and then providing for natural ventilation out these ports 72 or by providing a suitable blower as indicated by 74, properly preset to draw a certain amount of air from the area above the false ceiling, will remove the lamp heat from what is indicated in FIGS. 4 and 5 as incandescent lamps 76, thus removing this heat from the ceiling of the work area or control zone. It should be understood that the blowers 74 and/or the ducts 72 are independent of the control air flow through the main supply duct. Preferably, they will remove the amount of air necessary to allow about a 5° F. to about 10° F. temperature rise over the lamp 76 from air which is drawn from within the room through the cracks and/or leaks in the false ceiling 62 and out the ports 72.

Preferably, the small blowers, or the vents 72, will have variable speed drive or variable openings, but once they are set to a particular room they should not be adjusted.

We have found that these additional blowers or vents above the false ceiling and using recessed incandescent lights results in an acceptable minimal interference with the temperature and humidity within the room whether the lights are on or off and, hence, find it definitely preferable to include the false ceiling with recessed incandescent lights to define the structural aspects of the room, rather than any other lighting arrangement.

FIG. 5 also illustrates the positioning of an air aspirated temperature and humidity sensor at a point substantially in proximity to the center or the desired operating area of the control zone. This sensor is indicated by numeral 42 to conform to the indication of the schematic diagram of FIG. 3. The air aspiration gives a more accurate and quicker response to the actual conditions within the rooms, and these types of air aspirated sensors are well known so that any usual, commercially available model would meet the objects of the invention. The sensor 42 is preferably mounted by an umbilical cord so it can be moved to other locations within the room 10 to establish a different control zone location within the room, dependent on the desired use.

Further, we incorporate a high limit humidity sensor indicated by numeral 43 which is located in the supply air duct just inside the room, with the purpose of this sensor being to limit humidity overshoot in response to a sudden change in demand for increased humidity. Selectively, we can also incorporate anticipatory sensors which are understood by those skilled in the art to help eliminate hunting or overshooting of the control within the cooling coil 26.

The heat pack 18, if needed, is preferably an electric heater. It should be of a type which includes electric thermostatic control, and it is controlled in conjunction with the makeup air so that there is never the possibility that the coil 26 would have to go into a heating mode. The makeup air is preferably taken from any source where it will not create problems with other air circulation systems, but it should be of a makeup that is neither too hot nor too cold, and preferably as close to chamber conditions as possible, in which case, the heat pack 18 would not be normally activated.

The dehumidification coil 20 is of a conventional type as manufactured by Superradiator of Minneapolis, Minnesota, and is necessary only if the humidification level of the air from the makeup system is above 50 percent relative humidity. In addition, if the relative humidity of the input air is too high, then the appropriate controls, well known to those skilled in the art, associated at the output side from the dehumidification area 20, and as described hereinafter, will direct a sufficient portion of the air stream through the desiccant 22 so that the air coming into the main stream of duct 12 will be well below a 50 percent relative humidity level, and preferably will be at about 10 percent or less relative humidity with the temperature of the air at about 75° F.

We further contemplate that there be an actual mixing box, which is indicated by numeral 50, at the point where treated air or process air from duct 12 is mixed with reactivation air or input from duct 24. The characteristics of the mixing box are somewhat important to the overall operability of the invention, since a thorough mixing must be achieved therein between the processed air and the makeup air. Another important feature of the invention is that the makeup air, while comprising only between about 12 percent to 30 percent of the total air flow through chamber 10, actually substantially controls the temperature and humidity so that only small incremented charges are needed by units 26 and 28 on the full air flow to be processed.

Preferably, the air leaving the mixing chamber 50 is at about 75° F. and it then passes over the main cooling coil 26, which reduces the temperature to about 68° F., after which steam is injected into the air to increase the temperature slightly to about 69° F., and at about a 55 percent relative humidity.

With respect to the humidification section 28, we have found that a typical steam humidifier, such as that made by Armstrong Machine Works of Three Rivers, Michigan with steam pressure set at about 10 pounds, works quite satisfactorily for this purpose. However, any suitable humidification control system would work for the purposes of the invention.

A further critical aspect of the invention is with respect to the cooling coil 26. We have designed this so that there is more transfer surface than is conventionally utilized in air cooling equipment, for example, about 20 percent to about 35 percent greater than the heat transfer surface of a conventional coil for the same cooling load. We do this by spreading the heat transfer surface over a broader area with less depth. By oversizing the cooling coil and making the actual temperature of the coolant in the coil run higher than a conventional system, we operate this system so that it runs dry and there is not any humidification change within this area 26 at all. The higher temperature operation of the coolant in the coil 26 is preferably achieved in the manner taught in U.S. Pat. No. 3,734,810. One additional benefit of the modified coil 26 is that there is actually less load resistance to the air flow, both because of its oversizing and because it runs dry so there is no skin friction caused by moisture on the cooling surfaces. We find that the air pumping load is, hence, reduced between about 25 percent to about 50 percent of that in a conventional heat exchanger which actually allows the system to operate with a smaller horsepower in the blower 30.

We have further found that the amount of total air flow into the control zone 11 is much easier control for precise temperature and humidity levels if the volume of air flow is much higher than normally designed, specifically in the range of 4 to 6 cubic feet per minute per square foot of floor space, as contrasted to 1.5 to 2.5 for conventional systems. To achieve this air flow characteristic, we utilize blower 30, which inherently adds temperature to the air by the energy transmittal by the blowing configuration, and further this inherently causes some reduction in the relative humidity of the air on the output side of the blower 30.

It should be understood that the temperatures and humidity levels indicated throughout the system are typical only for the case described, and will vary dependent on the specifics desired for the control space or zone. It should also be understood that the sensing by sensors 42 may also be used to control the functioning of temperature and humidity control on the makeup air so that when mixed with the processed air, only smaller incremental changes need to be made in coil 26 and humidification section 28.

However, if desired, for more precise control of the makeup air, a separate sensor, indicated as 42*a*, could be located in the zone 11 so as to directly control the heat pack 18, coil 20, and desiccant 22 to insure the makeup air entering mixing box 50 is at about 10 percent relative humidity and over about 75° F. to 80° F. In addition, this can control a valve 80 on the bypass line 24 around the desiccant 22. As an alternative to sensor 42*a*, a sensor or sensors 42*b* can be located in the makeup air line just before the box 50 with signals from these sensors controlling the pack 18, coil 20, desiccant 22, and valve 80.

While in accordance with the patent statutes, only the best mode and preferred embodiment of the invention has been illustrated and described in detail, it is to be understood that the invention is not limited thereto or thereby. Therefore, for the true scope and breadth of the invention, reference should be had to the appended claims.

What is claimed is:

1. A method to achieve precise controlled humidity and temperature within a confined space wherein the process operates to the right of a line of a physchrometric chart between the point of desired temperature and humidity entering the confined space and the temperature and humidity in the air leaving the space, comprises the steps of:

(a) effecting circulation of a predetermined volume of air through the control space to achieve a substantially uniformed distribution of the air throughout the space;

(b) thoroughly mixing into the main stream a small portion of makeup air at a controlled humidity and temperature level to return the main stream to about the desired temperature and humidification levels;

(c) additionally selectively cooling the main stream of air with makeup air mixed without stripping any moisture therefrom;

(d) selectively adding moisture to the mixed air flow stream to bring the humidification level up;

(e) providing moving force to the air stream immediately subsequent to moisture addition to uniformly distribute the moisture throughout the air stream; and (f) effecting control of the makeup air input, the selective cooling and selective moisture addition by control means within the confined space.

2. A method according to claim 1 wherein the volume of air flow is in the range of about 4 to 6 cubic feet per minute per square foot of floor space in the confined space.

3. A method according to claim 2 where the makeup air comprises between about 12 percent to about 30 percent of the volume of the basic air flow through the confined space.

4. A method as defined in claim 3 wherein the cooling of the mixed main air stream and the makeup air stream is achieved selectively by a large heat exchanger operated such that the temperature change in the air is insufficient to cause any condensation onto the heat exchanger surface.

5. A method according to claim 4 which includes the step of selective removal of heat from the top of the confined space generated by lights separately from the main air stream passage through the space so as to prevent unacceptable changes in the main air stream caused by such lights.

6. Apparatus to achieve precise control humidity and temperature within a confined space wherein the process operates to the right of a line of a physchrometric chart between the point of desired temperature and humidity entering the confined space and the temperature and humidity in the air leaving the space, consisting of:

(a) means to effect circulation of a predetermined volume of air through the confined space to achieve a substantially uniformed distribution of the air through the space;

(b) means to thoroughly mix into the main stream a small portion of makeup air at a controlled humidity and temperature level to return the main stream to about the desired temperature and humidification levels;

(c) means to provide additional selective cooling of the main stream of air with makeup air mixed without stripping any moisture therefrom;

(d) means to selectively add moisture to the mixed air flow stream to provide a desired humidification level;

(e) means to provide turbulence within the air stream immediately subsequent to moisture addition to uniformly distribute the moisture throughout the air stream; and (f) control means within the confined space to effect control of the makeup air input, the selective cooling and selective moisture addition.

7. Apparatus according to claim 6 wherein the makeup air comprises between 12 percent to 30 percent of the main air stream through the confined space.

8. Apparatus according to claim 6 wherein the volume of air flow through the confined space is between about 4 to about 6 cubic feet per minute per square foot of floor space in the confined space.

* * * * *